US009901173B2

(12) United States Patent
Grabher et al.

(10) Patent No.: US 9,901,173 B2
(45) Date of Patent: Feb. 27, 2018

(54) FRAME FOR A DRAWER HAVING A FRAME BODY AS WELL AS A DRAWER AND FURNITURE ITEM HAVING A DRAWER

(71) Applicant: Grass GmbH, Hoechst (AT)

(72) Inventors: Guenter Grabher, Fussach (AT); Juergen Amann, Lustenau (AT); Patrick Pirker, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 14/882,610

(22) Filed: Oct. 14, 2015

(65) Prior Publication Data

US 2016/0106213 A1 Apr. 21, 2016

(30) Foreign Application Priority Data

Oct. 16, 2014 (DE) ..... 20 2014 104 929 U

(51) Int. Cl.
*A47B 88/00* (2017.01)
*A47B 96/20* (2006.01)
(Continued)

(52) U.S. Cl.
CPC ..... *A47B 96/20* (2013.01); *A47B 88/40* (2017.01); *A47B 88/941* (2017.01);
(Continued)

(58) Field of Classification Search
CPC ..... A47B 96/20; A47B 88/0014; A47B 88/04; A47B 2210/0002; A47B 2210/01;
(Continued)

(56) References Cited

U.S. PATENT DOCUMENTS 5,180,217 A * 1/1993 Lautenschlager .. A47B 88/0014 312/330.1
5,421,648 A * 6/1995 Grabher ..... A47B 88/10 312/331
(Continued)

FOREIGN PATENT DOCUMENTS

DE 20 2007 013 792 U1 3/2009
DE 10 2008 024 673 A1 11/2009
(Continued)

OTHER PUBLICATIONS

European Search Report (Application No. 15189553.9) dated Mar. 14, 2016.
(Continued)

*Primary Examiner* — Hanh V Tran
(74) *Attorney, Agent, or Firm* — Burr & Brown, PLLC

(57) ABSTRACT

A frame for a drawer having a frame body which comprises a cavity for receiving a drawer guiding system, wherein the frame body includes an inner base part and an outer covering element which covers the base part, and wherein the inner base part comprises receiving means for the drawer guiding system as well as a support for a bottom part of a drawer bottom. According to the invention, the covering element covers the base part fully or almost fully at least over the length thereof, wherein a top horizontal portion of the covering element is supported on the base part.

27 Claims, 5 Drawing Sheets

(51) Int. Cl.
*A47B 88/90* (2017.01)
*A47B 88/40* (2017.01)

(52) U.S. Cl.
CPC ... *A47B 2210/0002* (2013.01); *A47B 2210/01* (2013.01); *A47B 2210/02* (2013.01); *A47B 2210/094* (2013.01); *A47B 2210/097* (2013.01)

(58) Field of Classification Search
CPC ..... A47B 2210/02; A47B 2210/094; A47B 2210/097; A47B 88/40; A47B 88/941
USPC ..... 312/348.1, 348.2, 348.6
See application file for complete search history.

(56) References Cited

U.S. PATENT DOCUMENTS 5,439,284 A * 8/1995 Grabher ..... A47B 88/0422 312/334.6
5,452,952 A * 9/1995 Grabher ..... A47B 88/0014 312/348.1
5,462,349 A * 10/1995 Grabher ..... A47B 88/0014 312/330.1
5,478,146 A * 12/1995 Grabher ..... A47B 88/0014 312/348.1
5,492,400 A * 2/1996 Rock ..... A47B 88/10 312/331
5,494,348 A * 2/1996 Grabher ..... A47B 88/0014 312/263
5,536,083 A * 7/1996 Brustle ..... A47B 88/04 312/334.12
5,540,515 A * 7/1996 Rock ..... A47B 88/0051 292/341.17
5,556,183 A * 9/1996 Brustle ..... A47B 88/0422 312/330.1
5,564,807 A * 10/1996 Rock ..... A47B 88/047 312/331
5,971,516 A * 10/1999 Huber ..... A47B 88/0014 312/265.5
5,992,958 A * 11/1999 Scheible ..... A47B 88/0014 312/330.1
6,053,592 A * 4/2000 Sutterlutti ..... A47B 88/0014 312/330.1
6,095,627 A * 8/2000 Sutterlutti ..... A47B 88/0014 312/263
6,412,893 B1 * 7/2002 Muterthies ..... A47B 88/941 312/330.1
6,481,813 B1 * 11/2002 Muterthies ..... A47B 88/40 312/330.1
7,455,374 B2 * 11/2008 Nachbaur ..... A47B 88/0422 312/330.1
2004/0000851 A1 * 1/2004 Lam Harn ..... A47B 88/493 312/334.7
2006/0049730 A1 * 3/2006 Sutterlutti ..... A47B 88/00 312/330.1
2006/0049732 A1 * 3/2006 Prentner ..... A47B 88/14 312/334.1
2008/0315740 A1 * 12/2008 Lam ..... A47B 88/0014 312/334.1
2009/0058243 A1 * 3/2009 Weber ..... A47B 88/0055 312/348.4
2010/0102692 A1 4/2010 Hämmerle
2014/0049148 A1 * 2/2014 Gasser ..... A47B 88/0422 312/334.8
2015/0008812 A1 * 1/2015 Lawson ..... A47B 61/003 312/334.1
2015/0164223 A1 * 6/2015 Lawson ..... A47B 88/04 312/334.5

FOREIGN PATENT DOCUMENTS

DE 20 2009 005 203 U1 4/2010
DE 20 2010 003 512 U1 9/2011
DE 10 2010 036 706 A1 2/2012
WO 2009/006651 A2 1/2009

OTHER PUBLICATIONS

German Search Report (Application No. 20 2014 104 929.0) dated Aug. 28, 2015.

* cited by examiner

FRAME FOR A DRAWER HAVING A FRAME BODY AS WELL AS A DRAWER AND FURNITURE ITEM HAVING A DRAWER

This application claims the benefit under 35 USC § 119(a)-(d) of German Application No. 20 2014 104 929.0 filed Oct. 16, 2014, the entirety of which is incorporated herein by reference.

FIELD OF THE INVENTION

The present invention relates to a frame for a drawer having a frame body as well as a drawer having such a frame and a furniture item having a drawer.

BACKGROUND OF THE INVENTION

Diverse embodiments of frames, in particular hollow-chamber frames for drawers are already known in the prior art.

The advantage of hollow-chamber frames is that drawer guiding systems are able to be accommodated therein, as a result of which, for example, the installation height can be pared down or can be maximized for a drawer in a case with underfloor guide means. However, it is also necessary to match the drawer guiding system to a predetermined frame design.

SUMMARY OF THE INVENTION

The object underlying the invention is to expand the scope of use of a frame, in particular a hollow-chamber frame.

First of all, the invention proceeds from a frame for a drawer having a frame body which comprises a cavity for receiving a drawer guiding system, wherein the frame body includes an inner base part and an outer covering element which covers the base part, and wherein the inner base part comprises receiving means for the drawer guiding system as well as a support for a bottom part of a drawer bottom. The core of the present invention consists then in that the covering element covers the base part at least over the length thereof, wherein a top horizontal portion of the covering element is supported on the base part.

The top horizontal portion of the covering element is preferably supported at several points along the length of the base part which are interrupted by free regions.

A comparably rigid frame body which is usable for diverse frame forms can be created as a result of this measure.

In addition, the invention proceeds from a frame for a drawer having a frame body which comprises a cavity for receiving a drawer guiding system, wherein the frame body includes an inner base part and an outer covering element which covers the base part, and wherein the inner base part comprises receiving means for the drawer guiding system as well as a support for a bottom part of a drawer bottom. A further core of the invention consists in that the covering element covers the base part fully or almost fully over the length thereof, wherein a top horizontal portion of the covering element is at a spacing of less than 10 mm with respect to a horizontal portion of the base part for a substantial portion of the length of the covering element. More than 25% of the length of the frame is preferably to be understood as a substantial portion. As a result of the spacing of less than 10 mm, it is possible to produce basic frames with a comparatively small installation height, the height of which basic frames is able to be supplemented individually by attachment elements, it being possible to use the same frame body in each case. The spacing between the horizontal portions can also preferably be smaller than 8, 5, 4 or approximately 2 mm. In the most extreme case, the horizontal portions, that means the top horizontal portion of the covering element and a corresponding horizontal portion of the base element, are able to rest on one another. In excess of more than 90% of the length of the base part is preferably to be understood as "almost fully over the length".

So that a good connection to the rest of the drawer can be achieved with the covering element, it is further proposed that the covering element comprises a wiper lip for abutment against a top surface of a drawer bottom.

In this context, it is moreover preferred when the base part has a stop surface for the abutment of an end face of a drawer bottom.

In a further preferred development of the invention, the covering element forms the outside contour of the frame body which, in a mounted state on the finished drawer, is visible to a user on the outside from above and on the inside from above. The covering element preferably forms the complete outside contour of the frame body which, in the mounted state on a finished drawer, is correspondingly visible to a user on the outside from above and on the inside from above with reference to the drawer.

Over and above this, it is preferred when the base part comprises a maximum height of 50 mm. The base part is preferably approximately 44 mm in height. This achieves a large amount of flexibility for the base element which can be fitted with different covering elements according to the preferences of the individual user.

In addition, it is preferred for the covering element to have a maximum height of 55 mm. The height of the covering element is preferably approximately 46 mm. In the individual case, the covering element can cover the base part precisely or can be developed at least no higher than 55 mm when the base part is smaller in height.

In order to generate a stable bond, it is additionally advantageous when the base part has an outside contour which corresponds to the inside contour of the covering element.

In addition, it is advantageous when the base part extends over more than half the length of the covering element. The achievement of the dimensioning is that the base part on its own is capable of being able to transmit the necessary supporting forces of the frame for the drawer guiding system to the remaining drawer. The covering element preferably defines the full length of the frame body. Mounting elements, which protrude beyond this, for the attachment, for example, of a front and rear wall, are also provided where applicable.

When viewed over the length of the frame body, one single base part, that is one single receiving saddle, is preferably provided.

For efficient assembly, it is additionally provided that the base part has fastening means, in particular, a mounting claw, for a drawer bottom on the support for a bottom part of a drawer bottom.

In an additionally favorable development of the invention, the base part comprises an extensively closed outside form.

The outside form of the base part preferably corresponds to the frame up to the covering element and/or, where applicable, the final height of the frame body.

For simple assembly, it is proposed over and above this that the base part, when viewed in cross section, includes several connecting pieces, in particular, in a cavity of the base part, for a drawer guiding system.

In addition, it is preferred when mounting pillars which penetrate the covering element are provided.

The mounting pillars begin, in particular, on the base part. The mounting pillars preferably extend transversely with respect to the longitudinal extension of the frame, in particular vertically. The mounting pillars have a protrusion beyond a horizontal portion of the covering element. The protrusion defines the final height of the frame and can amount to several centimeters. The mounting pillars are preferably arranged in the respective end region of the base part and are advantageously connected to the covering element.

Two mounting pillars can be used, for example, as support elements for a wall element, in particular a hollow wall, which is placed above the support elements.

It is advantageous over and above this when there is provided a wall element which forms at least the top part of the frame with a top end face and oppositely situated vertical wall portions and when the wall element is fitted from above onto the frame body and fixed with the frame body.

For example, the wall element can be snapped onto the frame body and/or can be clamped to the frame body.

In a further advantageous embodiment of the invention, the wall element, in the mounted state on the frame body, for example on the covering element of the frame, forms a cavity which extends over the length of the frame above the covering element. This produces a high degree of flexibility for a default of the overall height of the frame which is freely adaptable above the frame body over the entire height of the cavity of the wall element. The base part with the covering element does not obstruct anything. In particular, stop elements for a front and/or rear wall for attachment on the base part are matched to the desired height of the frame.

In addition, it is preferred when the wall element has a recess for inserting a decorative surface. In this way, diverse design impressions can be realized on the frame at little expense by simply attaching a corresponding decorative surface in the recess.

In addition, it is preferred when the wall element forms the outside contour of the frame which, in a mounted state on the finished drawer, is visible to a user on the outside from above and on the inside from above. The outside contour is preferably fully formed by the wall element on a finished drawer when viewed on the outside from above and on the inside from above, that is to say the wall element covers the frame body up to a bottom opening for a drawer guiding system or completely up to end openings for the connection of the front wall and rear wall.

In addition, it is preferred when the wall element extends over more than half of a length of the frame. This means that the frame is able to be formed predominantly with the wall element.

Over and above this, it is advantageous for the wall element to have excellent fastening points for attachment on the frame body. For example, the wall element is mounted, for example clipped, on vertically extending mounting pillars at the excellent fastening points as a result of a movement from above.

BRIEF DESCRIPTION OF THE DRAWINGS

Several exemplary embodiments are explained in more detail by way of the drawings below providing further details and advantages, in which.

DETAILED DESCRIPTION OF THE INVENTION

Figure 1:
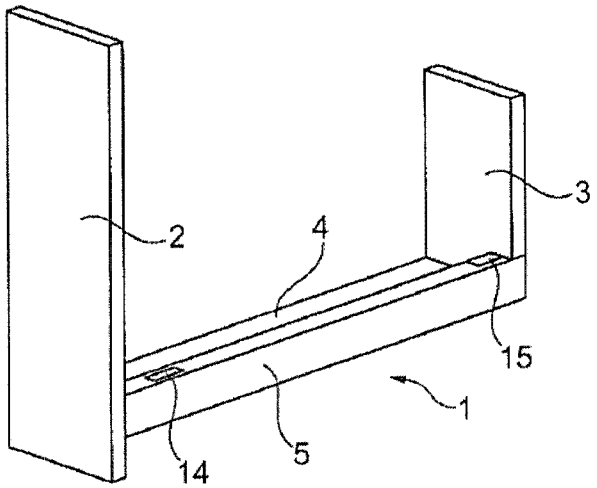
FIG. 1 shows a three-dimensional view of a detail of a drawer.
Figure 2:
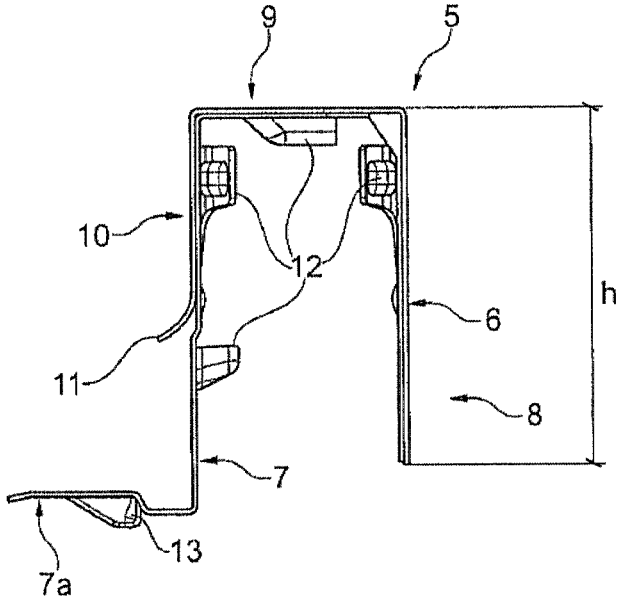
FIG. 2 shows a sectional view of a frame body.

FIG. 1 shows a detail of a drawer 1 with a drawer front 2, a rear wall 3, a drawer bottom 4 and a frame body 5. The frame body 5 is shown in section in FIG. 2.

The frame body 5 includes a covering element 6 as well as a base part 7. The covering element 6 covers the base part 7 on a right-hand outside surface 8, a horizontal connecting portion 9 and an inside surface 10 up to a wiper lip 11. Mounting devices 12 for fixing a drawer guiding system are provided on the base part 7. In addition, on the support 7*a* the base part 7 includes fastening claws 13 for a drawer bottom 4 which is arranged on the support 7*a* (see also FIGS. 7*a* and 7*b*). The covering element comprises, for example, a height of 46 mm, whereas the height of the base part 7 on the outside surface is one or two millimeters smaller.

In principle, the frame body 5 could be inserted as a drawer wall in a drawer according to FIG. 1 as a complete hollow-chamber frame.

In the present case, the horizontal connecting portion 9 has openings 14, 15. The openings 14, 15 are preferably penetrated by pillar-like mounting means which are connected to the base part 7 and protrude beyond the horizontal connection portion 9 of the covering element 6. These types of connecting means 16 are shown in part, for example, in FIG. 7*b*. Preferably not only the base part 7 is fastened on the connecting means 16 but also the covering element 6, in particular in the region of the horizontal connecting portion 9.

A rigid, comparatively sturdy arrangement made up of the base part 7, the covering element 6 and the connecting means 16 is created as a result.

Figure 3:
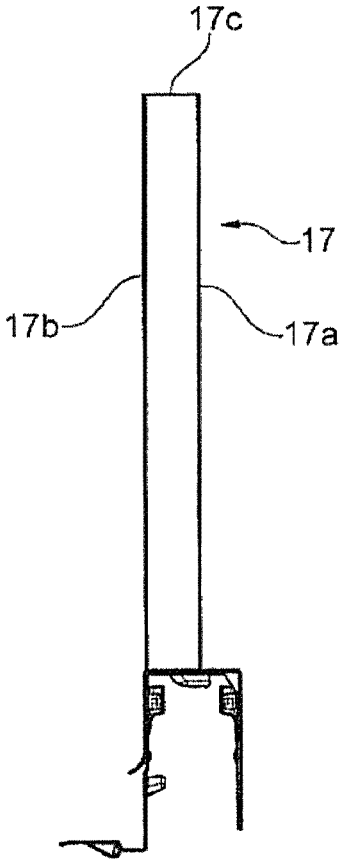
FIG. 3 shows a sectional view of a hollow-chamber frame.
Figure 4:
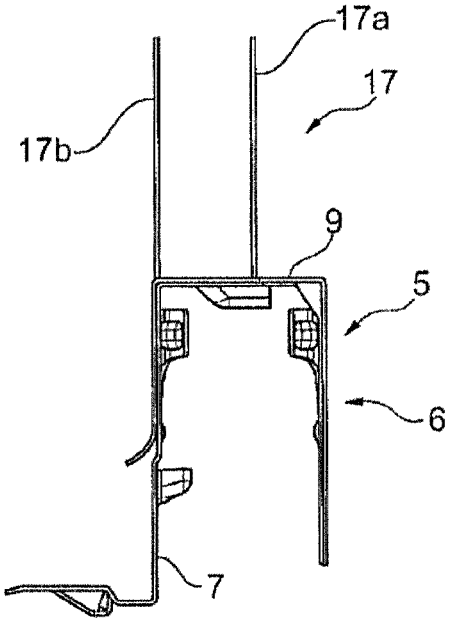
FIG. 4 shows a sectional view also of a detail of the hollow-chamber frame according to FIG. 3.
Figure 5:
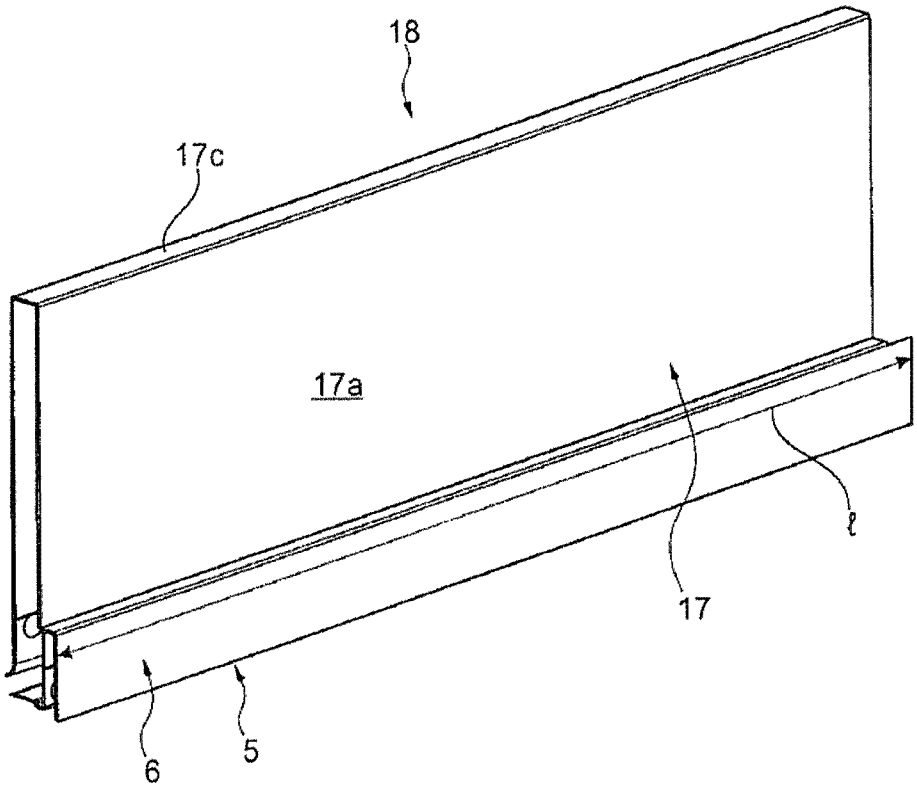
FIG. 5 shows a three-dimensional view of a hollow-chamber frame.

The connecting means 16 serve, for example, for the purpose of receiving a hollow wall element 17 (see in particular FIGS. 3 to 5). For example, the wall element 17 comprises fastening points for attachment to the connecting means 16.

FIG. 5 shows the then complete hollow-chamber frame 18 consisting of the body 5 and the wall element 17.

Both the covering element 6 and the wall element 17 are preferably produced from sheet metal as bending metal parts.

The wall element 17 includes an outside wall 17*a*, an inside wall 17*b* and a horizontal portion 17*c*.

In the embodiment according to FIGS. 3 to 5, the wall element 17 sits obtusely on the horizontal connecting portion 9 of the covering element 6. Consequently, the outside surface of the hollow-chamber frame 18 is defined by the wall element 17 and the covering element 6.

The wall element 17 is preferably simply fitted onto the frame body 5 at the connecting means 16.

It is consequently possible to provide a frame body 5 in a simple manner with different wall elements 17 which comprise a varied design, for example varied colors.

A frame 18 which is constructed in this manner consequently has a high degree of flexibility with regard to individual customer wishes with respect to the development of a drawer.

Figure 6:
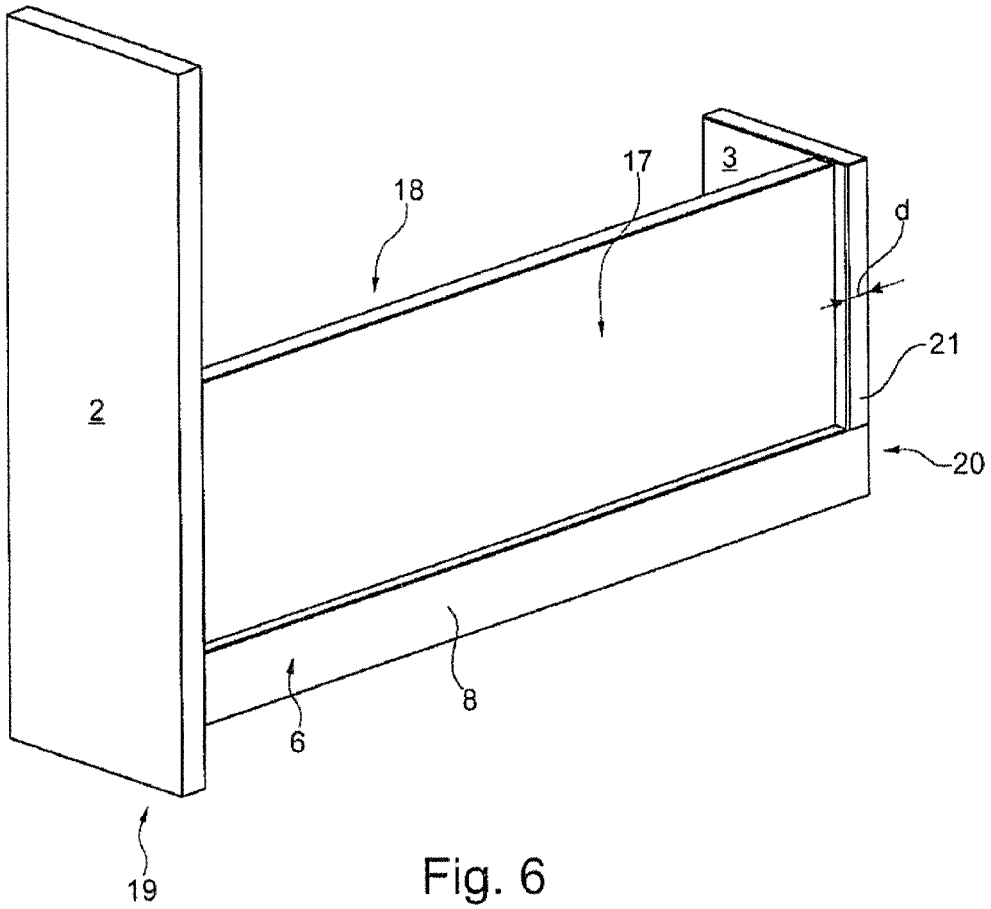
FIG. 6 shows a three-dimensional part view of the drawer with the hollow-chamber frame from FIG. 5 integrated into a drawer structure.

A drawer 19 which is provided with the hollow-chamber frame 18 is shown in FIG. 6. It is possible to see the hollow-chamber frame 18 as well as part of the drawer front 2 and part of the rear wall 3.

The outside surface 8 of the covering element 6 is longer by a wall thickness d of the rear wall 3 at a rear end 20 with reference to the wall element 17 or the remaining frame body 5 such that, when viewed from the outside, the outside surface 8 covers a narrow side 21 of the rear wall 3 at the rear end 20.

In the exemplary example according to FIGS. 1 to 5, the covering element 6 abuts against the base part 7 in a manner corresponding to the contour of the base part, in particular also the horizontal portion 9. A compact rigid structure is created as a result.

The base part 7 extends in an advantageous manner over the largest region of a length 1 of the covering element 6, at least over more than 50% of the length, such that the base part 7 provides a receiving structure, which is independent per se, for a drawer guiding system.

The wall element 17 can be developed in a varied manner.

Figure 7A:
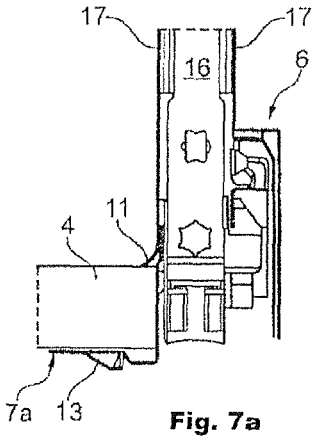
FIGS. 7*a* and 7*b* show a front view (7*a*) and a perspective view obliquely from above (7*b*) of a detail of a hollow-chamber frame with mounting means for a drawer front and a drawer bottom that is shown in part.
Figure 7B:
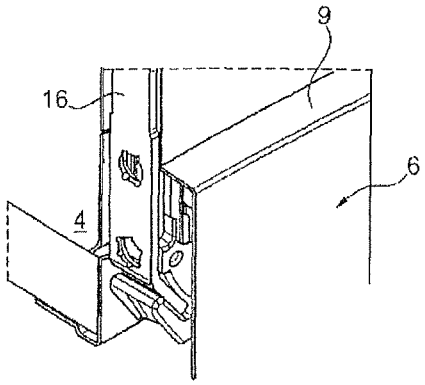

In the development according to FIGS. 3 to 6 as well as 7*a* and 7*b*, the wall element 17 ends at the horizontal connecting portion 9 such that the covering element 6 provides the wiper lip 11 for a drawer bottom 4 (see in particular FIGS. 7*a* and 7*b*).

The covering element 6 is penetrated in the vertical direction by the connecting means 16. The connecting means 16 can serve not only for receiving the wall element 17 but also for attaching the drawer front 2 and the rear wall 3.

FIGS. 8*a*-8*d* show a perspective representation of parts of four different developments of wall elements.

Figures 8A, 8B, 8C, 8D:
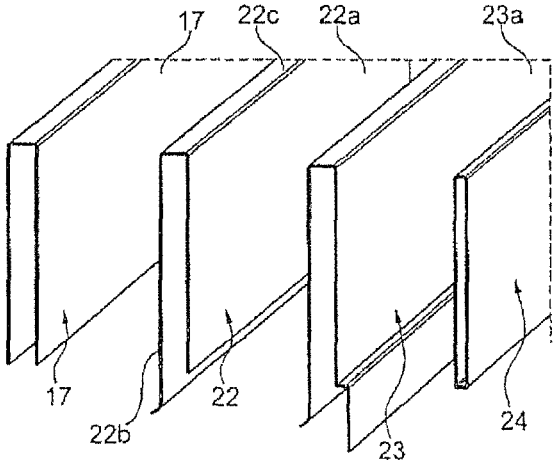
FIGS. 8*a* to 8*d* show in each case perspective part views of different wall elements for a hollow-chamber frame for example according to FIGS. 1 and 2.

FIG. 8*a* shows the wall element 17 corresponding to FIGS. 3 to 6 and 7*a* and 7*b*.

FIG. 8*b* shows a wall element 22 which includes an extended inside surface 22*b* with a wiper lip 11. In the case of the embodiment, the wall element 22, which can be fitted in particular in a manner comparable to the wall element 17, consequently defines the total inside surface of a drawer from a horizontal portion 22*c* to a drawer bottom 4. An outside surface 22*a* corresponds to the outside surface 17*a* of the wall element 17.

The embodiment according to FIG. 8*c* differs from that according to FIG. 8*b* in that now, in the fitted state, also an outside surface 23*a* of the wall element 23 covers both the remaining horizontal connecting portion 9 and the outside surface 8 of the covering element 6 in a total manner. This means that the wall element 23 provides both the inside surface and the outside surface of a drawer frame in a total manner. Even greater possibilities to develop a hollow-chamber frame totally individually in a quick and simply different manner, for example according to customer wishes, are produced as a result.

FIG. 8*d* shows a wall element 24 in a solid development, for example produced from glass, which is mountable between receiving means (not shown) on the connecting means 16.

A large amount of freedom of design to use wall elements 24 that are solidly developed or at least have the same geometric dimensions is also produced in this manner.

LIST OF REFERENCES

1 Drawer
2 Drawer front
3 Rear wall
4 Drawer bottom
5 Frame body
6 Covering element
7 Base part
7*a* Support
8 Outside surface
9 Horizontal connecting portion
10 Inside surface
11 Wiper lip
12 Connecting device
13 Fastening claw
14 Opening
15 Opening
16 Connecting means
17 Wall element
17*a* Outside surface
17*b* Inside surface
17*c* Horizontal portion
18 Hollow-chamber frame
19 Drawer
20 Rear end
21 Narrow side
22 Wall element
22*a* Outside surface
22*b* Inside surface
22*c* Horizontal portion
23 Wall element
24 Wall element

The invention claimed is:

1. A frame for a drawer having a frame body which comprises a first cavity for receiving a drawer guiding system, wherein the frame body includes an inner base part and an outer covering element which covers the base part, wherein the inner base part comprises receiving means for the drawer guiding system as well as a support for a bottom part of a drawer bottom, wherein the covering element covers the base part fully or almost fully at least over the length thereof, wherein a top horizontal portion of the covering element is supported on the base part, wherein the covering element has a first end, a second end, a longitudinal length between the first end and the second end, and a width substantially perpendicular to the longitudinal length, and wherein the base part extends over more than half the longitudinal length of the covering element, and a wall element forming a top portion of the frame body, the wall element consisting of an elongated substantially horizontal top portion having opposing first and second edges, and opposing first and second substantially vertical wall portions depending from the respective opposing first and second edges of the elongated substantially horizontal top portion, the opposing first and second substantially vertical wall portions being mounted on the covering element, thereby defining a second cavity extending over the longitudinal length of the covering element.

2. The frame according to claim 1, wherein the covering element comprises a wiper lip for abutment against a top surface of a drawer bottom.

3. The frame according to claim 1, wherein the base part has a stop surface for the abutment of an end face of a drawer bottom.

4. The frame according to claim 1, wherein the covering element forms the outside contour of the frame body which, in a mounted state on the finished drawer, is visible to a user on the outside and on the inside from above.

5. The frame according to claim 1, wherein the base part comprises a maximum height of 50 mm.

6. The frame according to claim 1, wherein the covering element has a maximum height of 55 mm.

7. The frame according to claim 1, wherein the base part has an outside contour which corresponds to the inside contour of the covering element.

8. The frame according to claim 1, wherein the base part has fastening means including a mounting claw, for a drawer bottom on the support for a bottom part of a drawer bottom.

9. The frame according claim 1, wherein the base part comprises an extensively closed outside form.

10. The frame according to claim 1, wherein the base part, when viewed in cross section, includes several connecting pieces for a drawer guiding system.

11. The frame according to claim 1, wherein the wall element comprises a recess for inserting a decorative surface.

12. The frame according to claim 1, wherein the wall element forms the outside contour of the frame which, in a mounted state on the finished drawer, is visible to a user on the outside and on the inside from above.

13. A drawer having a frame according to claim 1.

14. A furniture item having a drawer according to claim 13.

15. A frame for a drawer having a frame body which comprises a first cavity for receiving a drawer guiding system, wherein the frame body includes an inner base part and an outer covering element which covers the base part, wherein the inner base part comprises receiving means for the drawer guiding system as well as a support for a bottom part of a drawer bottom, wherein the covering element covers the base part at least over the length thereof, wherein a top horizontal portion of the covering element is at a spacing of <10 mm with respect to a horizontal portion of the base part for a substantial portion of the length of the covering element, wherein the covering element has a first end, a second end, a longitudinal length between the first end and the second end, and a width substantially perpendicular to the longitudinal length, and wherein the base part extends over more than half of the longitudinal length of the covering element, and a wall element forming a top portion of the frame body, the wall element consisting of an elongated substantially horizontal top portion having opposing first and second edges, and opposing first and second substantially vertical wall portions depending from the respective opposing first and second edges of the elongated substantially horizontal top portion, the opposing first and second substantially vertical wall portions being mounted on the covering element, thereby defining a second cavity extending over the longitudinal length of the covering element.

16. The frame according to claim 15, wherein the covering element comprises a wiper lip for abutment against a top surface of a drawer bottom.

17. The frame according to claim 15, wherein the base part has a stop surface for the abutment of an end face of a drawer bottom.

18. The frame according to claim 15, wherein the covering element forms the outside contour of the frame body which, in a mounted state on the finished drawer, is visible to a user on the outside and on the inside from above.

19. The frame according to claim 15, wherein the base part comprises a maximum height of 50 mm.

20. The frame according to claim 15, wherein the covering element has a maximum height of 55 mm.

21. The frame according to claim 15, wherein the base part has an outside contour which corresponds to the inside contour of the covering element.

22. The frame according to claim 15, wherein the base part extends over more than half of a length of the covering element.

23. The frame according to claim 15, wherein the base part has fastening means, including a mounting claw, for a drawer bottom on the support for a bottom part of a drawer bottom.

24. The frame according claim 15, wherein the base part comprises an extensively closed outside form.

25. The frame according to claim 15, wherein the base part, when viewed in cross section, includes several connecting pieces for a drawer guiding system.

26. The frame according to claim 15, wherein mounting pillars which penetrate the covering element are provided.

27. The frame according to claim 15, further comprising a wall element which forms at least the top part of the frame with a top end face and oppositely situated vertical wall portions and in that the wall element is fitted from above onto the frame body and fixed with the frame body.

* * * * *